US008616098B1

(12) United States Patent
Rosow

(10) Patent No.: US 8,616,098 B1
(45) Date of Patent: Dec. 31, 2013

(54) HANDLE FOR TOOLS

(75) Inventor: Alice Rosow, Brooklyn, NY (US)

(73) Assignee: Mystic Apparel LLC, New York City, NY (US)

( * ) Notice: Subject to any disclaimer, the term of this patent is extended or adjusted under 35 U.S.C. 154(b) by 216 days.

(21) Appl. No.: 13/183,066

(22) Filed: Jul. 14, 2011

(51) Int. Cl.
*B25G 1/10* (2006.01)

(52) U.S. Cl.
USPC ..... 81/489; 16/430

(58) Field of Classification Search
USPC ..... 81/489; 16/430; D8/107, 313
See application file for complete search history.

(56) References Cited

U.S. PATENT DOCUMENTS

| | | | | | |
|---|---|---|---|---|---|
| D226,410 | S | * | 2/1973 | Kunze | D7/649 |
| 3,879,048 | A | * | 4/1975 | Penney | 280/821 |
| D236,579 | S | * | 9/1975 | Morback | D7/649 |
| D331,171 | S | * | 11/1992 | Berthet | D7/395 |
| D355,831 | S | * | 2/1995 | Hull et al. | D8/107 |
| 5,692,265 | A | * | 12/1997 | Dalury | 16/430 |
| 5,737,803 | A | * | 4/1998 | Tisdale | 16/430 |
| D411,077 | S | * | 6/1999 | Kwok | D7/395 |
| 6,009,600 | A | * | 1/2000 | Egeland et al. | 16/436 |
| D426,136 | S | * | 6/2000 | Yu | D8/107 |
| D427,030 | S | * | 6/2000 | Wen | D8/1 |
| RE37,190 | E | * | 5/2001 | Stowell et al. | 16/422 |
| D446,437 | S | * | 8/2001 | Chen | D8/107 |
| 6,419,601 | B1 | * | 7/2002 | Kenner | 473/552 |
| D463,244 | S | * | 9/2002 | Chen | D8/107 |
| D465,397 | S | * | 11/2002 | Chen | D8/107 |
| D466,390 | S | * | 12/2002 | Hung | D8/107 |
| 6,502,314 | B1 | * | 1/2003 | McCatty | 30/340 |
| D476,535 | S | * | 7/2003 | Garon | D7/649 |
| 6,662,406 | B2 | * | 12/2003 | Shonfeld et al. | 16/431 |
| D498,130 | S | * | 11/2004 | Tomchak et al. | D8/107 |
| D515,393 | S | * | 2/2006 | Lin | D8/107 |
| D515,905 | S | * | 2/2006 | Chen | D8/107 |
| D522,342 | S | * | 6/2006 | Kwan | D8/107 |
| 7,284,300 | B1 | * | 10/2007 | Bruns | 16/430 |
| 7,578,731 | B1 | * | 8/2009 | Moore | 452/103 |
| 7,621,023 | B2 | * | 11/2009 | Pyatt | 16/430 |
| D614,010 | S | * | 4/2010 | Hyp | D8/107 |
| D625,572 | S | * | 10/2010 | Hoertnagl | D8/45 |
| 7,828,305 | B2 | * | 11/2010 | Meyers et al. | 280/87.021 |
| 7,836,557 | B2 | * | 11/2010 | Baker | 16/430 |
| 7,930,804 | B2 | * | 4/2011 | Cornfield | 16/430 |
| 7,976,100 | B2 | * | 7/2011 | Chen et al. | 297/183.6 |
| 7,976,365 | B1 | * | 7/2011 | King | 452/6 |
| 8,006,351 | B2 | * | 8/2011 | Baker | 16/430 |
| 2005/0138777 | A1 | * | 6/2005 | Cornfield | 16/430 |

(Continued)

*Primary Examiner* — David B Thomas
(74) *Attorney, Agent, or Firm* — Andrew S. Langsam; Pryor Cashman LLP

(57) ABSTRACT

A handle for a garden tool, a kitchen utensil, a hardware tool, an implement, device, preferably cookware and/or a pot or pan comprises a soft, resilient material formed into three horizontally-extending (to the longitudinal axis of the handle) finger troughs. A slight recess for a fourth finger, and a thumb rest, located on the bottom and top, respectively, extend along the longitudinal axis of the handle. The thumb rest is at least partially superimposed over the fourth (or pointer) finger recess and is at least partially forward or distal to the end of the handle as the troughs and the fourth or pointer finger recess of the handle. The soft material (polypropylene and/or thermoplastic rubber) for the handle along with the finger troughs and the thumb rest allow the handle to be comfortable in use, very easy to control the item to which the handle is attached, and still allows for heat insulation between the item to which the handle is attached and the user's hand.

16 Claims, 4 Drawing Sheets

(56) References Cited

U.S. PATENT DOCUMENTS

2005/0241111 A1* 11/2005 Prokop ..... 16/430
2007/0101547 A1* 5/2007 Egeland ..... 16/430
2008/0163463 A1* 7/2008 Hulden ..... 16/430
2009/0183343 A1* 7/2009 Baker ..... 16/430
2011/0203426 A1* 8/2011 Cornfield ..... 81/489
2012/0110787 A1* 5/2012 Quiggins et al. ..... 16/430

* cited by examiner

HANDLE FOR TOOLS

FIELD OF THE INVENTION

The present invention relates to an ergonomic handle or a handle component for use in connection with an array of tools (garden, hardware, kitchen, etc.) and other tools and implements but is primarily intended for use as the handle for a cooking utensil and/or a vessel, like a pot or pan. The new and inventive handle is made in a basic cylindrical form, of diameter which can be easily held within one's hand. Preferably, the bottom of the handle is provided with spaced finger troughs for three or four of the five fingers of a hand and is provided with a fifth, thumb finger trough or location opposed, i.e., on the top side of the handle, i.e., opposed to the first three or four finger troughs (on the bottom of the handle) to allow the user to hold and balance, with ease and dexterity, the tool, cooking utensil, pot or pan provided with the handle.

Preferably, the new handle is made of a resilient, yet sturdy material so that the gripping of the same by the user's hand is comfortable even for long periods of time. Preferably the material is a combination of polypropylene (a plastic) and thermoplastic rubber (natural or man made). The TPR, whether natural or synthetic, has a long coiled polymer chain. For putting the material to best use-to get good strength, age, oil, oxidation resistance, the rubber can be mixed with a vulcanising chemical, which will crosslink the polymeric chains. On heating the TPR composition, like the polypropylene, the plastic/rubber flows like a plastic which can be made to fill a mold. The present invention, a handle for a tool, implement, utensil, etc. can be an add-on handle which slips over a prior-provided handle or the handle provided herein can be new to the product and integrated into the same as the original handle.

The thumb trough or rest, on the top of the handle and opposed to the troughs for the three or four of the other fingers of the hand, provides a convenient and easy balance point and cantilever, again, ensuring that the user has control and comfort in using the device to which the handle is attached. This can be important in using kitchen utensils, pots and pans which often require movement of the pan and its material (food) with respect to a plate, flipping of the food stuff, etc.

The material for the handle is preferably heat resistant, too. The grip of one's hand on the handle for long periods of time will not cause unnecessary heat from the metal pot or pan to be transmitted up to and through the holding handle to the user's hand. The resilience of the material of the handle comprised preferably of both polypropylene and the thermoplastic rubber, whether one composition is used or if the two components are combined together to form a single handle, i.e., parts of the handle made with polypropylene and parts of the handle made of the thermoplastic rubber, provide a soft cushioned feel and yet an insulative holding place for a hand. This allows for a soft "feel" for the handle and this allows the same to be held for long periods of time without discomfort.

A single design of the handle is configured for ease of use by both left and right handed users. Preferably, the troughs for the three fingers, pinky, ring, and middle finger are provided and extend across the longitudinal axis of the handle while a fourth or pointer finger trough or slightly recessed section is provided distal from the end of the handle (with respect to the troughs) and comprises a slight curved recess aligned with the longitudinal handle.

Located on top of the handle, opposed to the side with the three or four troughs and yet substantially above yet forward (more distal) of the slight recess for the fourth finger, is a thumb rest. At least in part the thumb rest is meant to be superimposed over the slight recess for the fourth finger. The thumb rest is also in the shape of a slight curved recess and extends along and in the general direction of the longitudinal axis of the handle and provides a resting point, a leverage asserting point, and a cantilever point for the thumb of the user's hand. The new handle is an improvement over the handles of the prior art and results in a far easier to use, more comfortable, longer usable, and lightweight and heat insulating handle than prior art handles.

The handle of the present invention is particularly useful and useable in connection with kitchen utensils, pots, pans, and, yet, it can be used, too, to great advantage in connection with a wheelbarrow handle, poles for use in painting ceilings, garden tools, e.g., rakes, hoes, electric trimmers, etc and hardware items with handles.

DESCRIPTION OF THE RELATED ART

Handles have been provided to a wide variety of products to enable and facilitate the use of the same by one or more hands of the user. The handles are generally cylindrical and of a small enough diameter that the user's hand wraps around the handle such that a strong grip can hold the handle with little difficulty. Handles are provided, for example, to pots and pans, kitchen utensils, hardware tools, garden tools, wheelbarrows, poles for use with paint rollers, etc. These handles are generally cylindrical, sometimes formed of heat resistant material (surely in the case of kitchen utensils, pots and pans) and sometimes even formed with one or more cross-wise or angular troughs for providing location-holding areas for the fingers of the holding hand. However, when the handles are used for long periods of time, the handle becomes uncomfortable, can be hard to precisely control and can even become too hot to easily and comfortably handle (in connection with food pots and pans/utensils). Yet, dexterity and "feel" are important with the use of handles for many implements.

It is an object of the present invention to provide a handle, capable of being installed onto and/or integrated into the holder for kitchen utensil, any tool, a pot or a pan, etc. which handle is very comfortable and easy to use and which allows for the ease of use and precise control over the device to which the handle(s) is attached. It is a further object of the present invention to provide a handle which is heat insulative and, yet, has a soft and cushioned feel so that long periods of use can occur without discomfort. The feel of the handle, of course, results too in precision of use and this can be quite important in a handle for cookware. Also, the configuration of the inventive handle, having three cross-wise pinky, ring and middle finger-holding troughs on the bottom of the handle, and then, located distally, a slight curved (and at 90 degrees) recess for the pointer finger, all on the bottom, the top of the handle having a thumb rest, located forwardly, slightly superimposed over the fourth finger recess, and distal to the proximal or end of the handle than the three troughs, the thumb rest allowing for ease of control, precision of use, and comfort, all provides an improved and highly useful device.

The prior art seems to be in need of an easy to use, comfortable over long periods of time, inexpensive and heat insulative handle for tools, utensils, pots and pans. The present invention accomplishes these goals and others.

SUMMARY OF THE INVENTION

The present invention relates to a new and improved handle. The handle can be used for kitchen utensils used in cooking, garden tools, kitchen tools, hardware tools, poles used for roll-on painting, for hand tools, pots and pans, etc.

but is especially intended for use in connection with cooking utensils, used with pots and pans wherein food is moved about and prepared at low, medium and even high heat. The present invention, in its preferred form, comprises an ergonomic handle which is generally cylindrical in shape and sized for holding by a hand, can be provided with an aperture or hole for allowing the same to be hung on an overhead kitchen utensil rack or by a peg board, and is integrated to or molded as the end of the handle for a kitchen utensil, a pot or pan. The inventive handle is preferably formed of a resilient and soft-to-the-touch polypropylene or thermoplastic rubber (synthetic or natural) material which not only is easy to hold, slightly resilient but allows the holder to hold the same for long periods of time without discomfort. Also, the handle is meant to provide a thermal barrier to insulate the heat of the pot or pan from the hand on the handle and this, too, is more comfortable and yet allows for longer time of direct contact between the user's hand and the handle.

Several troughs extending across the longitudinal axis of the handle, spaced apart, and two gradually sloping recesses, extending along the longitudinal handle, are provided which are meant to provide holding locations for four of the five fingers. A thumb rest is on top of the handle with the other troughs and a recess (if provided for the pointer finger) located on the bottom of the handle.

DETAILED DESCRIPTION OF THE INVENTION, THE DRAWINGS AND THE PREFERRED EMBODIMENT

Figure 1:
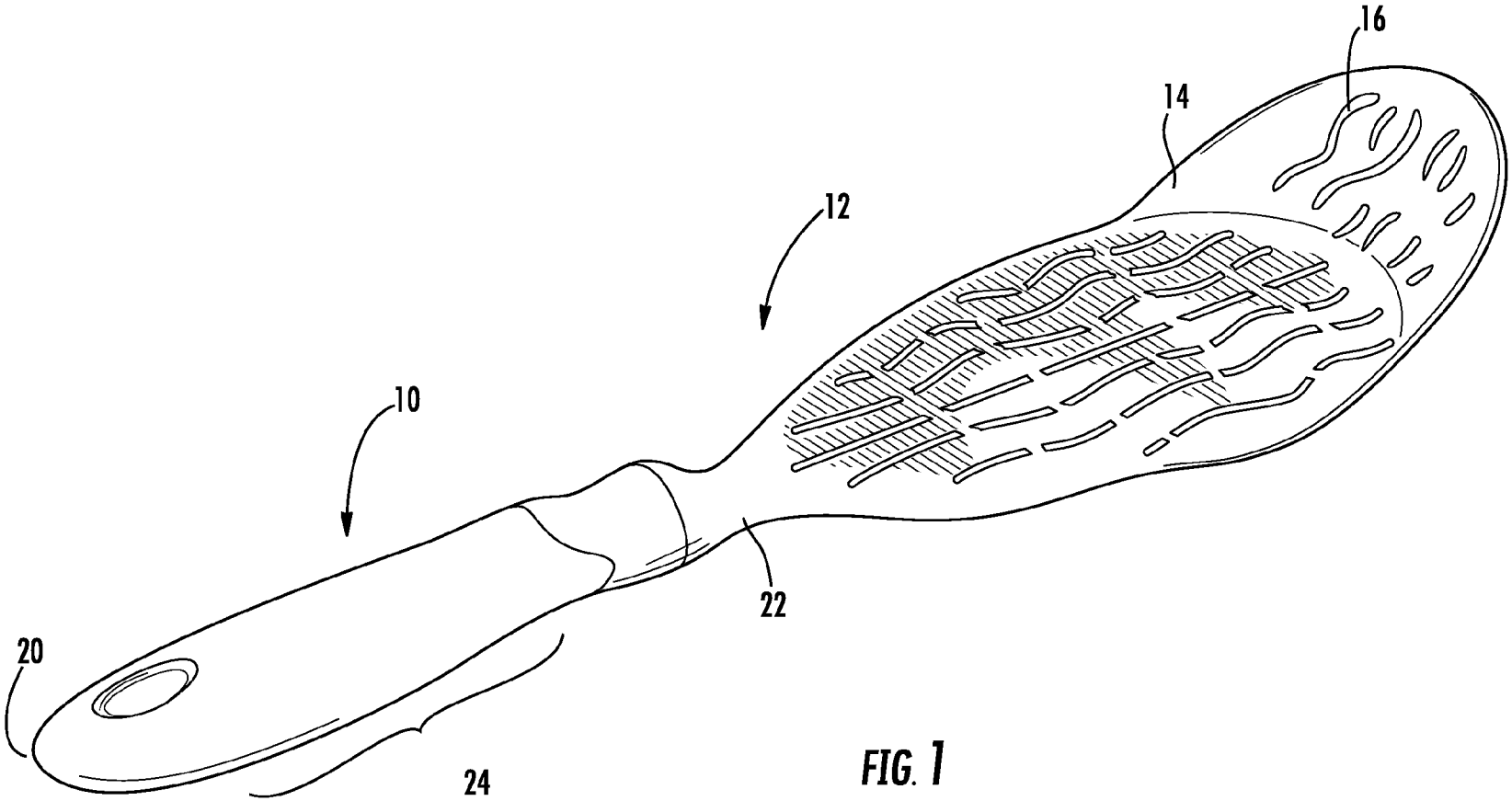
FIG. 1 is a perspective view of the present inventive handle shown as the handle for a kitchen tool, a combination sieve, food spatula, and "mover" of stir-fried food within a pan.

Description will now be given with reference to the attached FIGS. 1 through 8. It should be understood that these Figures are exemplary in nature and in no way serve to limit the scope of the invention, which is defined by the claims appearing hereinbelow.

The present invention, as seen in the Drawings, comprises a handle component 10 for a utensil or tool 12. The handle 10 can be for use with a kitchen tool or utensil, a garden tool, a hardware tool, a wheelbarrow; a pole; a fishing rod; anything that has a handle for allowing for gripping by a user's hand. The diameter and length of the handle are, of course, meant to be sized for the intended user's hand and their grip so that the dimensions set forth herein, for men, for example, can be downsized slightly for women and further downsized for young children.

The present invention is intended to have primary applicability and use in connection with cookware, namely, utensils used with pots and pans used in a kitchen where the pot and/or pan is placed over heat and the heat, in the absence of the insulative aspects of the inventive handle, would result in heat being uncomfortably transmitted to the handle.

As shown in FIG. 1, the handle 10 is attached and integrated into a kitchen utensil 12—in this case a food "mover" for sautéing of food, a strainer, a scooper of food from a pot or pan for cooking and serving. Here, the distal end 14 of the tool is provided with a set of slits 16, of varying shapes and/or dimensions, to allow for liquid within which the food is being cooked, to flow through the tool, leaving behind the cooked food (like asparagus being sautéed in butter). The tool end 14 of the kitchen utensil 12, is not a part of the present invention and is shown herein merely for illustrative and environmental purposes. Other tool and utensil ends 14 can be used with the present inventive handle 10. As mentioned above and for illustration purposes and not by way of limitation, the handle can be attachable to or integrated with (in known manner) other handles and other tools. For example, the handle can be an after-market component to be attached, if desired, to the original equipment of a wheelbarrow. Or the handle can be integrated to the handles of the originally-sold wheelbarrow. The handle 10 can be integrated or securable to a wide variety of tools, e.g., rakes, hoes, shovels, painters' poles; cutting shears, hardware tools, garden tools, kitchen tools and utensils, etc. Preferably, however, the handles 10 of the present invention, are intended to be integrated into a cookware utensil for use with cooking foots in pots and pans at low, medium and high heat settings.

As seen in FIG. 1, the handle has a proximal end or tip 20, a distal end or tool connection end 22, and a central hand-gripping section 24. Generally, the shape of the handle is cylindrical with a longitudinal axis 50. The handle, according to the preferred embodiment of the invention, is made primarily from a stiff rubber or silicon-like composite material (polypropylene is preferred and the handle can be formed/molded with synthetic or natural thermoplastic rubber, too) which while rigid enough to support the weight of the food of the pot or pan (or other tool) laden with material to be carried by the tool, is at least slightly resilient to the touch and provides a soft, cushioned feel. There is some resilience to the handle when it is gripped by a user such that the feel of the handle within the hand of the user is comfortable and the handle conforms, at least in part, to the specific configuration, size, and dimension of the user's hand, a consequence of the resilience of the handle.

The handle is generally of a basic cylindrical hand-holdable shape although tapered towards its tip 20. At the other end of the handle, depending upon the device or tool to which the handle is attached, the cross section will match or be integrated with the continuation of the handle of the tool or into the tool/utensil itself. Alternatively, of course, the handle can be a hollow sleeve for sliding over the existing end of a tool (once the original handle is removed) or, in some configurations, the handle can be slid over the original handle and held in place. In the shown embodiment, the cross section of the handle 10 is mostly circular (slightly oval) at end 22 since it is a mere continuation of the handle of a conventional pot or pan.

Figure 3:
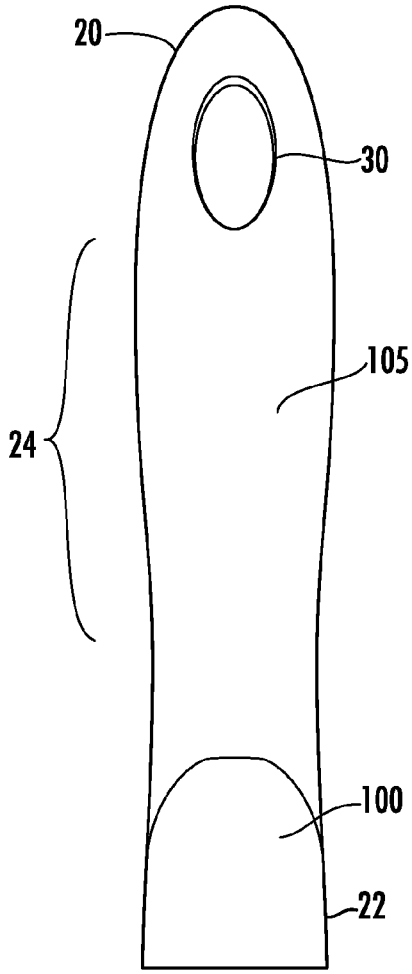
FIG. 3 is a top plan view of the inventive handle component shown in FIGS. 1 and 2.

As seen in FIG. 3, the handle 10 is provided with a hanging hole or aperture 30, passing entirely through the handle, to allow and facilitate the hanging of the tool, like the hanging of pots or pans, from a hook (not shown). The tip 20 and the hanging hole 30 are provided with smooth edges and curvature so that no sharp edges are provided, ensuring comfort and ease of use, and, at the same time, safety.

Figure 2:
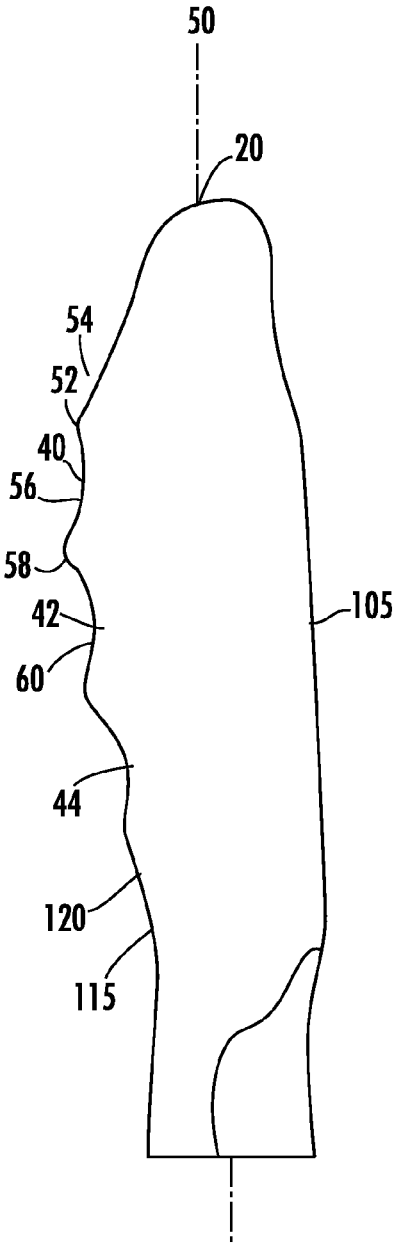
FIG. 2 is a side elevational view of the inventive handle component, with the attached utensil, cooking implement, tool, pot or pan not being shown in the Figure, for ease of illustration of the inventive aspects of the invention.
Figure 4:
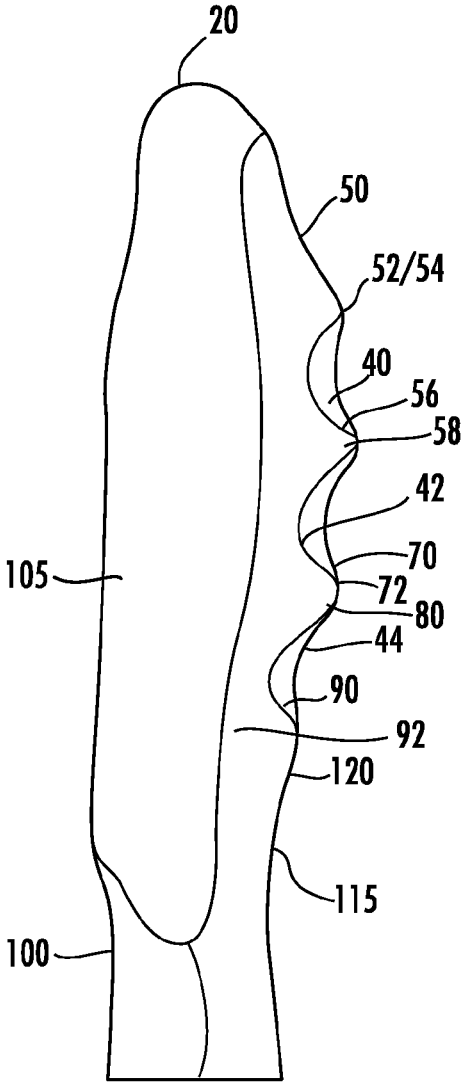
FIG. 4 is the other side elevational view of the inventive handle, i.e., opposed to that shown in FIG. 3.
Figure 5:
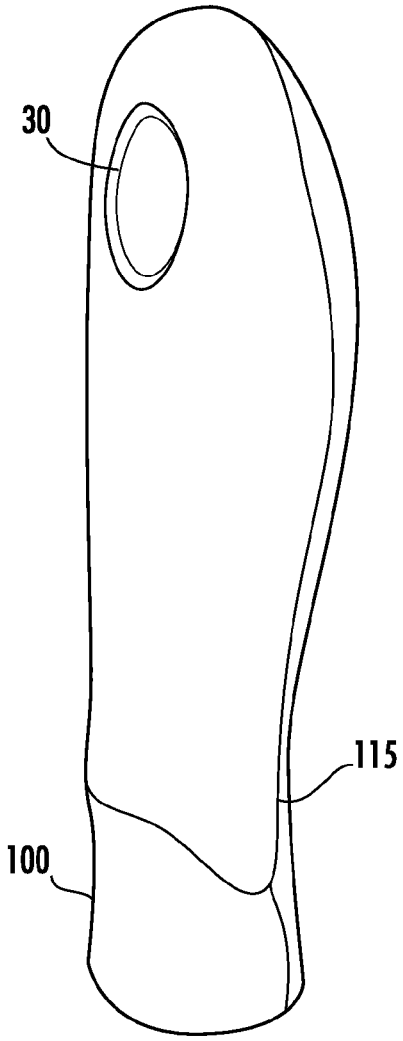
FIG. 5 is a top perspective view of the handle component shown in FIGS. 2, 3, and 4.
Figure 6:
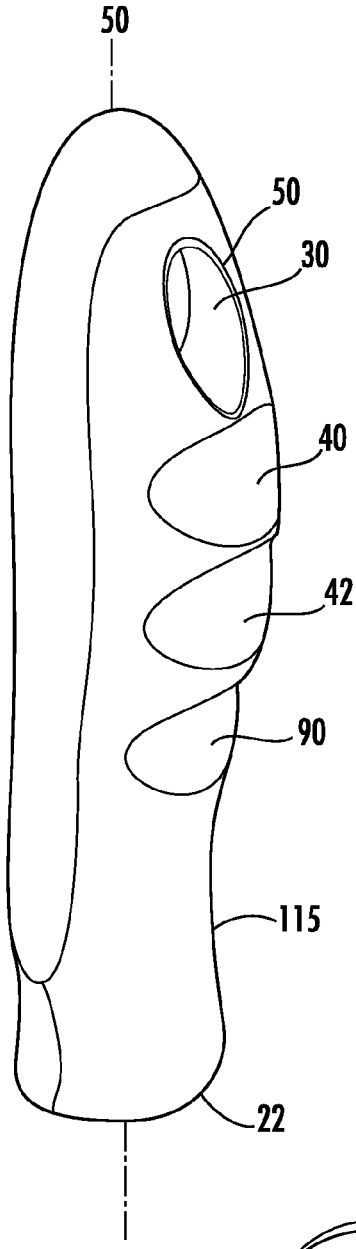
FIG. 6 is a bottom perspective view of the handle component shown in FIGS. 2, 3, and 4, similar to that shown in FIG. 5 but showing the bottom surface of the handle component.
Figure 7:
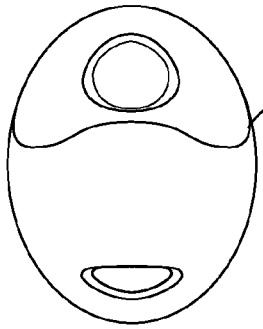
FIG. 7 is a front, head on view of the proximal end of the handle, in its preferred embodiment.
Figure 8:
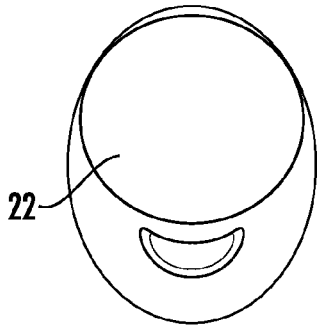
FIG. 8 is a cross sectional view of the handle component as it would appear if detached from and no longer integrated to the extension of the handle which is fixed to the device, tool, utensil, pot or pan to which it is attached.

As best seen in FIGS. 2, 4, and 6, the central portion 24 of the handle 10, is provided with three cross-wise troughs, 40, 42, and 44. These troughs extend across the longitudinal axis 50 of the handle. The first trough 40 is intended to accommodate the pinky finger of a user. The second or middle trough 42 is intended to accommodate the ring finger of the user. The third trough 44, the most distal trough from the tip 20 and closest to the end 22 of the handle 10, is intended to accommodate the middle finger of a user. As mentioned, these troughs extend across the longitudinal axis 50 of the handle and are able to easily and comfortably receive the pinky, ring, and middle finger of either a right or a left-handed user, with equal comfort and utility. The resilience and comfort is enhanced by the soft and resilient material of the handle. In the preferred embodiment the bottom is formed of a silicone-based or vulcanized rubber material TPR, and the top section is formed of a plastic-based material, like polypropylene. Together these materials can be molded and formed into a handle 10.

In the preferred embodiment of the invention, the hanging hole 30 is about 20 mm in length (along its major or long elliptical axis) and about 10 mm across its minor or smaller elliptical axis. The hanging hole has its edge at about 10.50 mm from the tip 20 of the handle. The handle's tip 20 is tapered from the generally cylindrical dimension of the handle. The overall diameter of the handle is about 28.12 mm at its widest, for use with a utensil used with household kitchen pots or pans. The tip's taper is gradual.

The hanging hole or aperture, seen best in FIG. 3, provides, as discerned by review of FIG. 4, to have an inclined wall 50 and a bottom edge 52 which is preferably about 30.5 mm from the tip 20 of the handle 10. The bottom edge 52 is the first peak 54 defining the first trough 56 for the pinky finger of the user. That first trough is about 17 mm in longitudinal length along the axis 50 of the handle and commences at about 30.50 mm from the tip 20. The first trough presents a slight concave wall or shape and is easily adapted to be comfortable and properly located for an easily holding by the pinky finger of a user. The distal end of the first trough 56 terminates in a peak 58. That is the first end of the second trough 60, for the ring finger of the user. That trough 60, like that of first trough 56, is slightly concave and is shaped and located to be easily and comfortably secured by the ring finger of the user. In the preferred embodiment, the second trough extends about 18 mm from the peak 58. The second trough extends to the next peak 70 which is the end of the second trough but the beginning of the third trough. In an alternate embodiment, as seen in FIG. 4, there is a space between the second peak 70 of the second trough and the first peak of the third trough.

Extending distal from tip 20, is, thus, the hanging hole, the first trough 56 and the second trough 60. A slight distance or spacing 72 may exist between peak 70 and the first peak 80 of the third trough 90. The third trough 90 extends from peak 80 to another peak 92 and in the preferred embodiment is about 16.50 mm in length along the longitudinal axis 50 of the handle 10. The top of the handle, i.e., the surface of the handle opposed to the underside or bottom bearing the first, second, and third troughs, is small in radius of curvature, curved to fit the palm of the hand and is also preferably made of a soft, and resilient material. The end of the third trough (the peak 92) is preferably located at about 39.02 mm from the end 22 of the handle.

In the preferred embodiment, the distance across the major axis of the handle 10 at the end 22 is about 26 mm while the distance of the handle from top to bottom (see FIG. 4) at the end 22 is only about 23.11 mm. In overall preferred dimensions, the most standard handle, for a utensil or piece of cookware to be used with a pot or pan, is likely to be about 132 mm in length, from tip 20 to end 22. If the handle is made to be of different lengths and dimensions, depending upon usage and tool, of course, the dimensions may change, keeping some proportionality, however, to the various troughs, locations of peaks, length of sections, ends, and the thumb rest.

As seen in FIG. 3, the top 105 of the handle 10, opposed to the bottom with the first, second and third troughs 40, 42, and 90, is a thumb rest section 100. The thumb rest 100 is slightly concave and extends for about 28.99 mm from the end 22. The major axis of the thumb rest is about 28.99 mm in length, extending along the major or longitudinal axis 50 of the handle. The bottom of the handle, opposed to where the thumb rest 100 is located, is about 17.60 mm from the end 22 of the handle (as seen in FIG. 4). Thus, it will be appreciated that there is some overlap or superimposition of the thumb rest 100 over the fourth finger recess 105.

According to the preferred embodiment of the invention, the underside or bottom 120 of the handle 10, in addition to having the first, second and third troughs, is provided with a pointer finger-hold location 115. This slightly concave area extends for about 39.02 mm from the end 22 of the handle and preferably has its reflexion point at about 17.60 mm from the end 22 of the handle. It is in that slight recess/concave area 115 that the user's pointer finger can be located to counteract and be placed beneath the thumb of the user, located in the thumb rest 100. The pointer finger rest area can be seen in FIG. 4 to extend from the end 22 of the handle to the second peak 92 of the third trough 90.

In use, the handle 10 is integrated into a device to be used—a tool, utensil, a pot or a pan, etc. Alternatively, the handle is hollow and can slip over and grip onto the extending rounded or cylindrical handles of the device to replace the same and provide a comfortable and easy to operate new set of handles. In any event, with the new handle(s) located onto the end of a tool or utensil, or a pot or pan, the user can easily, comfortably, and for a long period of time, place his pinky in the first trough 40, his ring finger in the second trough 42 and his middle finger in the third trough 90. The user's pointer finger can be placed in the slight recess 115 and with the user's pointer finger placed in the slight recess 115 and the thumb of the user's hand easily and comfortably in the thumb rest 100, leverage and precision and comfort are achieved. This provides great dexterity of use of the handle 10 and control of the user over the tool, utensil, pot or pan, etc. and their contents.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

The invention claimed is:

1. A tool handle comprising a basic, cylindrical-like hand gripping surface defining a longitudinal axis of the handle, a free proximal tip and a distal tool-contacting end at opposite ends of said longitudinal axis of the handle, said handle comprising a resilient, heat-insulative bottom surface and a hard, top surface for the palm, said bottom surface comprising three parallel trough areas, one for each of the pinky, ring and middle fingers of a user, each of said three trough areas having a distinct curvature with the centers of the radius of curvature in at least two horizontal planes with respect to the top surface and spacing designed to roughly correspond to that of adult pinky, ring, and middle fingers, respectively, of a user, said troughs being spaced apart from one another and spaced along said longitudinal axis and said troughs extending across and substantially perpendicular to said longitudinal axis, a fourth or pointer finger recess distal to said three troughs and in said bottom and in alignment with said longitudinal axis, said pointer finger recess being substantially less deep than said troughs and extending a greater length of said handle than one of said troughs, and a thumb rest in the form of a slight recess, on said top surface, at least partially superimposed above said fourth or pointer finger recess, said thumb rest also being aligned with the longitudinal axis of said handle and providing a cantilever position for said handle when held by a hand, said thumb rest and said pointer finger recess at their distal ends diverging only slightly outwardly toward said distal, tool-contacting end so that the same substantially smoothly continues and serves as an extension and support of the device supported by said handle.

2. A tool handle as claimed in claim 1 wherein said handle is formed of a thermoplastic rubber-based material.

3. A tool handle as claimed in claim 1 wherein said handle is formed of polypropylene-based material.

4. A tool handle as claimed in claim 1 wherein said three troughs on said bottom are about 16.5 to 18 mm in length, as measured along said longitudinal axis.

5. A tool handle as claimed in claim 1 extending about 132 mm in length from said proximal tip to said distal, tool-contacting section.

6. A tool handle as claimed in claim 1 wherein said cylindrical-like hand gripping surface is about 23 mm in diameter.

7. A tool handle as claimed in claim 1 further comprising a hanging aperture passing through said proximal tip.

8. A tool handle as claimed in claim 7 wherein said aperture is oval and about 20 mm in its major axis and about 10 mm in its minor axis.

9. A tool handle as claimed in claim 7 wherein one end of said aperture is located at about 10.5 mm from the proximal tip.

10. A tool handle as claimed in claim 1 wherein said thumb rest extends about 28.99 mm along said longitudinal axis.

11. A tool handle as claimed in claim 1 wherein said superimposition of said thumb rest over said fourth or pointer finger recess is all but about 10.03 mm along said longitudinal axis of said handle.

12. A tool handle as claimed in claim 1 wherein said bottom is formed of either of polypropylene or thermoplastic rubber and the top is formed of the other of either polypropylene or thermoplastic rubber.

13. A tool handle as claimed in claim 1 secured to a kitchen utensil.

14. A tool handle as claimed in claim 1 secured to a pot or pan.

15. A tool handle as claimed in claim 1 secured to a garden utensil.

16. A tool handle as claimed in claim 1 secured to a hardware tool.

* * * * *